US011559724B2

(12) United States Patent
Norfleet-Vilaro

(10) Patent No.: US 11,559,724 B2
(45) Date of Patent: Jan. 24, 2023

(54) SYSTEM TO DETERMINE AND DICTATE INDIVIDUAL EXERCISE THRESHOLDS TO MAXIMIZE DESIRED NEUROLOGICAL RESPONSE

(71) Applicant: David Lowell Norfleet-Vilaro, Ardsley on Hudson, NY (US)

(72) Inventor: David Lowell Norfleet-Vilaro, Ardsley on Hudson, NY (US)

( * ) Notice: Subject to any disclaimer, the term of this patent is extended or adjusted under 35 U.S.C. 154(b) by 0 days.

(21) Appl. No.: 15/929,644

(22) Filed: May 14, 2020

(65) Prior Publication Data

US 2021/0162260 A1 Jun. 3, 2021

Related U.S. Application Data

(60) Provisional application No. 62/943,035, filed on Dec. 3, 2019.

(51) Int. Cl.

| | |
|---|---|
| ***A63B 24/00*** | (2006.01) |
| ***A63B 22/06*** | (2006.01) |
| ***A63B 22/02*** | (2006.01) |
| ***A63B 71/06*** | (2006.01) |
| ***A63B 69/32*** | (2006.01) |

(52) U.S. Cl.

CPC ..... *A63B 24/0075* (2013.01); *A63B 22/02* (2013.01); *A63B 22/0605* (2013.01); *A63B 22/0664* (2013.01); *A63B 24/0062* (2013.01); *A63B 69/32* (2013.01); *A63B 71/0622* (2013.01); *A63B 2024/0093* (2013.01); *A63B 2071/0694* (2013.01); *A63B 2230/062* (2013.01)

(58) Field of Classification Search

None

See application file for complete search history.

(56) References Cited

U.S. PATENT DOCUMENTS

| | | | | |
|---|---|---|---|---|
| 5,410,472 | A * | 4/1995 | Anderson | G16Z 99/00 482/9 |
| 5,810,747 | A | 9/1998 | Brudny et al. | |
| 6,416,485 | B1 | 7/2002 | Rovetta et al. | |
| 6,666,831 | B1 | 12/2003 | Edgerton et al. | |
| 7,837,599 | B2 | 11/2010 | Kowalczewski et al. | |
| 7,892,189 | B2 | 2/2011 | Kandori et al. | |
| 8,523,741 | B2 | 9/2013 | Chiu et al. | |
| 9,067,098 | B2 | 6/2015 | Alberts | |
| 9,414,776 | B2 | 8/2016 | Sillay et al. | |
| 9,808,627 | B2 | 11/2017 | Gliner et al. | |
| 9,877,680 | B1 | 1/2018 | Giuffrida et al. | |
| 10,039,682 | B2 | 8/2018 | Einav et al. | |
| 10,058,736 | B2 | 8/2018 | Ridgel et al. | |
| 10,271,768 | B1 | 4/2019 | Murali | |
| 10,448,868 | B2 | 10/2019 | Friedman et al. | |
| 10,576,348 | B1 * | 3/2020 | Hawkins, III | A63B 71/0622 |
| 2009/0227429 | A1 * | 9/2009 | Baudhuin | A63B 24/0062 482/57 |
| 2009/0259148 | A1 | 10/2009 | Willmann et al. | |
| 2011/0251468 | A1 | 10/2011 | Osorio | |
| 2015/0290454 | A1 | 10/2015 | Tyler et al. | |
| 2018/0206774 | A1 | 7/2018 | Huang | |

(Continued)

*Primary Examiner* — Sundhara M Ganesan
*Assistant Examiner* — Shila Jalalzadeh Abyaneh
(74) *Attorney, Agent, or Firm* — Joy S. Goudie; Goudie, PLLC

(57) ABSTRACT

A system to determine and dictate individual exercise thresholds to maximize desired neurological responses.

5 Claims, 2 Drawing Sheets

(56) References Cited

U.S. PATENT DOCUMENTS

| | | | | |
|---|---|---|---|---|
| 2018/0218791 | A1 | 8/2018 | Rubin et al. | |
| 2019/0126099 | A1* | 5/2019 | Hoang | A63F 13/335 |
| 2020/0179757 | A1* | 6/2020 | Toivonen | G16H 10/20 |
| 2020/0254311 | A1* | 8/2020 | Watterson | G09B 19/0038 |
| 2020/0276475 | A1* | 9/2020 | Casalini | G16H 20/30 |
| 2021/0077887 | A1* | 3/2021 | Moritz | A63B 24/0087 |

* cited by examiner

SYSTEM TO DETERMINE AND DICTATE INDIVIDUAL EXERCISE THRESHOLDS TO MAXIMIZE DESIRED NEUROLOGICAL RESPONSE

CROSS-REFERENCE TO RELATED APPLICATION

This application claims the benefit of priority of U.S. provisional application No. 62/943,035, filed 3 Dec. 2019, the contents of which are herein incorporated by reference.

BACKGROUND OF THE INVENTION

The present invention relates to physical and neurological enhancement systems, and particularly to a system to determine and dictate individual exercise thresholds to maximize desired neurological responses.

Forced-rate exercise, such as threshold-targeted indoor cycling or boxing, has been found to reduce or delay symptoms associated with movement disorders, such as Parkinson's Disease through improved neurological response. Thus, improved neurological response from targeted exercise can bring additional desired effects to many populations.

Existing exercise protocols, however, use general thresholds for frequency or individual power thresholds based on previous exercise sessions. These one-size-fits-all frequency and potentially outdated power thresholds are often ineffective (as they rely on historic performance data from known or assumed participants). As a result, not only is the frequency threshold likely to differ from person to person and day to day, but a power threshold can vary greatly for a person with a movement disorder and can change unexpectedly in any population with atypical neurological patterns or tendencies.

In short, because all other protocols require generalized thresholds or thresholds based on pre-exercise data or testing, current protocols are not helpful to those outside the statistical average nor do they offer a useable starting point for a new participant.

As can be seen, there is a need for a system to determine and dictate individual exercise thresholds to maximize desired neurological responses. The present invention may use only current data from two sensors to initially determine and recalibrate the exercise thresholds for effectuating maximum desired neurological response, such as reducing tremors for people with Parkinson's Disease or improve the walking gait of someone with Progressive Supranuclear Palsy.

The systemic software embodied in the present invention accepts data in the form of current frequency, and power generated by an exercise routine, applies an algorithm to determine the initial thresholds, continues monitoring and updating thresholds during the exercise and displays easy and intuitive cueing so participants can reach and maintain their thresholds, maximizing the desired neurological results while minimizing unproductive physical effort and strain.

SUMMARY OF THE INVENTION

In one aspect of the present invention, a system to maximize neurological responses during a physical activity includes the following: a display; and a system controller forming one or more cues as a function of a frequency and power of an initial electrical output of the physical activity, and wherein the system controller is configured to represent on the display each cue as a function of a frequency and load of a future electrical output of the physical activity; exercise equipment associated with the physical activity; one or more sensor electrically connected to the exercise equipment for sensing respective electrical output; a series of color-coded zones represented on the display as a function of the initial electrical output, wherein each cue comprises an electronic ideogram (e.g., emoji or smile).

In another aspect of the present invention, a method for maximizing neurological responses during a physical activity further includes: providing the above-mentioned system; representing on the display one or more initial cues associated with one or more power intervals; establishing a baseline threshold as a function of said initial electrical output associated with said initial cues; and representing on the display one or more surge cues as a function of the baseline threshold and an instant electrical output of the physical activity.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a system to determine and dictate individual exercise thresholds to maximize desired neurological responses.

Figure 1:
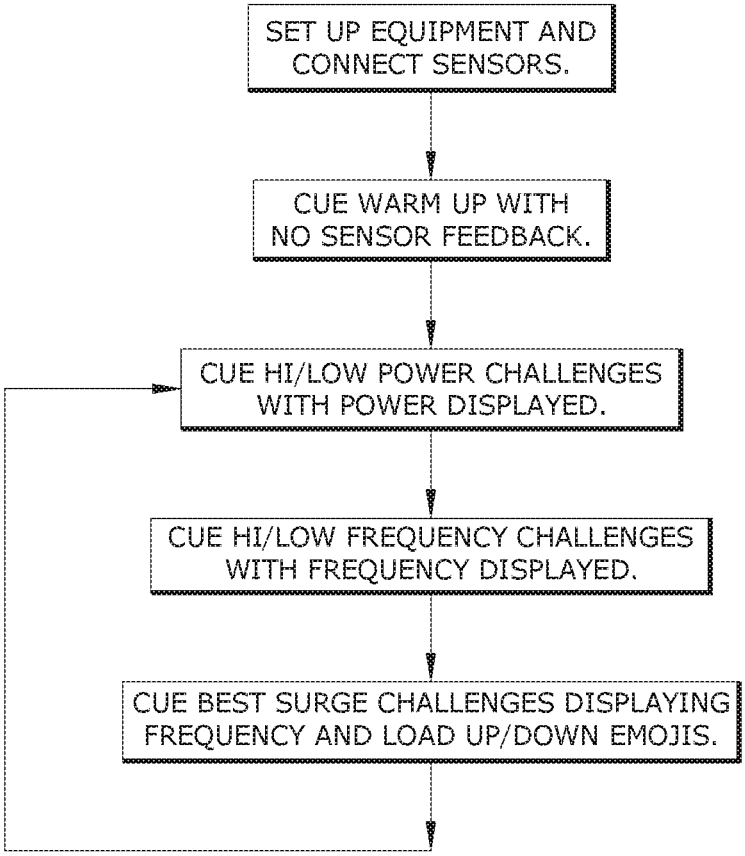
FIG. 1 is a flow chart view of an exemplary embodiment of the present invention.
Figure 2:
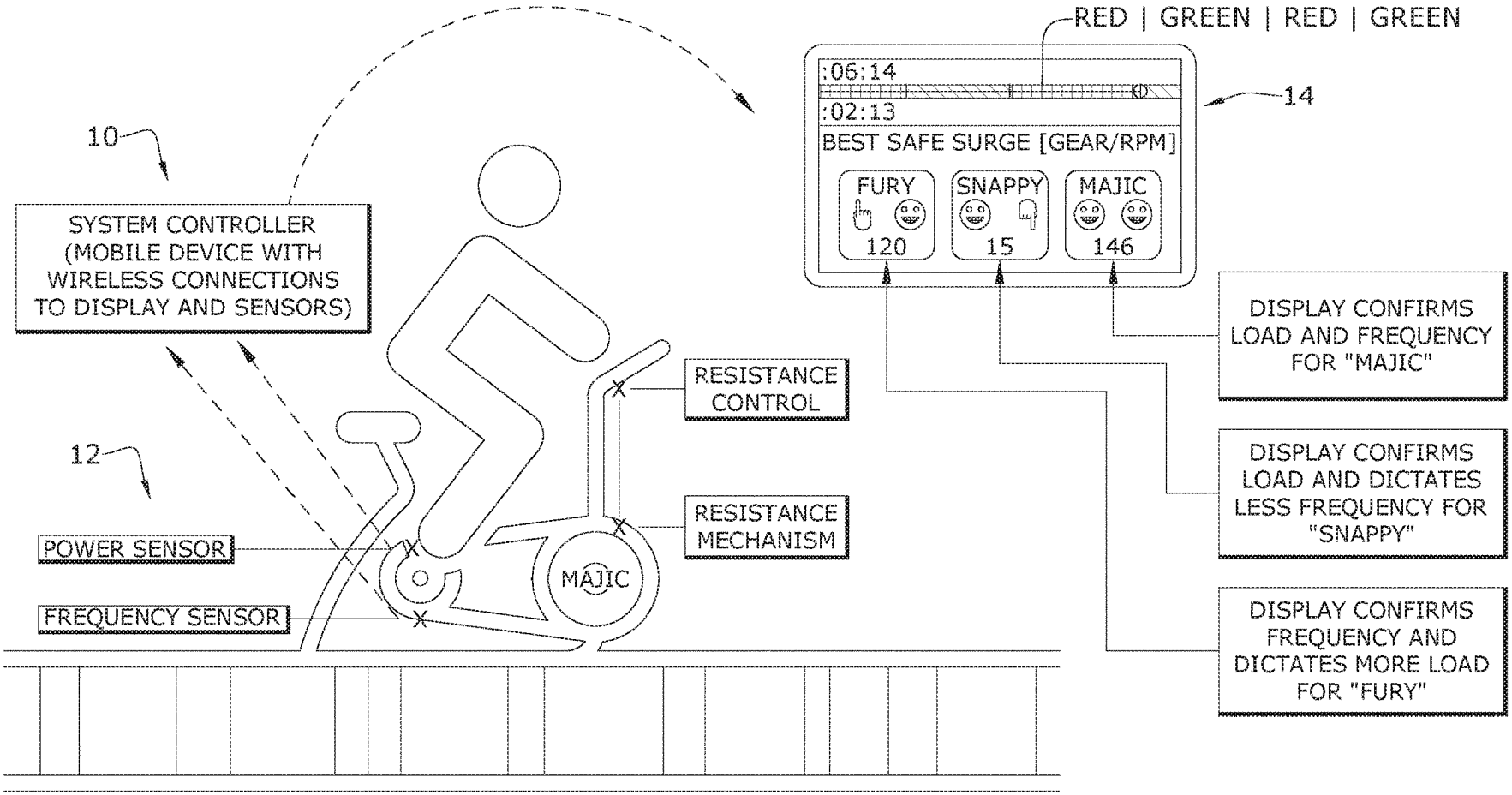
FIG. 2 is a schematic view of an exemplary embodiment of the present invention.

Referring to FIGS. 1 through 2, the present invention may include at least one computer with a user interface. The computer may include at least one processing unit coupled to a form of memory. The computer may include, but not limited to, a microprocessor, a server, a desktop, laptop, and smart device, such as, a tablet, smart phone or wearable device. The computer includes a program product including a machine-readable program code for causing, when executed, the computer to perform steps. The program product may include software which may either be loaded onto the computer or accessed by the computer. The loaded software may include an application on a smart device. The software may be accessed by the computer using a web browser. The computer may access the software via the web browser using the internet, extranet, intranet, host server, internet cloud and the like.

The ordered combination of various ad hoc and automated tasks in the presently disclosed system necessarily achieves technological improvements through the specific processes described more in detail below. In addition, the unconventional and unique aspects of these specific automation processes represent a sharp contrast to merely providing a well-known or routine environment for performing a manual or mental task.

The present invention may embody the following systemic components:

(A) A system controller 10, such as a computing device, a mobile device with Bluetooth™ Low Energy (BLE) capability, or equivalent. The system controller 10 adapted to calculate exercise thresholds and threshold-associated cues as a function of electrical data.

(B) Exercise equipment having a controllable resistance mechanism/transducer.

(C) One or more sensors 12 electrically connected to a resistance mechanism/transducer associated with the exercise equipment, wherein the sensors 12 may be adapted to sense electrical data (current and voltage) and thus frequency and power.

(D) A display 14 electrically coupled to the system controller 10, the display 14 adapted to represent said exercise thresholds and threshold-associated cues.

The present invention may be adapted to work as follows. During the first few minutes of an exercise routine, participants are guided through an increasing power warm up, then cues for high intensity power intervals, by way of the display 14, prompt the participant to give short zones of best power, and then cues for similar on/off RPM challenge intervals zones from comfortable to challenging frequencies.

The system controller 10 may be adapted to monitor both a frequency and a power associated with the exercise equipment used during said exercise routine to establish the baseline thresholds. As the exercise session progresses, the same two data streams are consistently monitored and used to establish and refine the thresholds which are visible on the panel display 14. While setting the baseline with power and frequency interval drills, work is guided by simple color coded working zones (such as green/easy and red/best as illustrated in FIG. 2), and the user may be informed of the working zone pattern by observing the strip of zone colors that is the background of the progress bar on the panel display 14.

Algorithms Used by the Present Invention:

During each second of sensor data flow, the power at that time (current_power) and the frequency at that time (current_frequency) are used to update the average power (average_power) and average frequency (average_frequency). The following formulas are then used to update the threshold power (threshold_power) and the threshold frequency (threshold_frequency). Finally, the last formulas are used to determine the load and frequency emoji cues:

```
Power Threshold
if (current_power > threshold_power)
        {
                constant = (average_power / current_power) *
(average_power / current_power) / 3.0
                threshold_power = (current_power * constant) +
(threshold_power * (1.0 – constant))
        }
Frequency Threshold
if ( (current_frequency > threshold_frequency) AND
(current_power/threshold_power > 0.85) AND
(current_power/threshold_power < 1.05) )
        {
                constant = (average_frequency / current_frequency) *
(average_frequency / current_frequency) / 3.0
                threshold_frequency = (current_frequency * constant) +
(threshold_frequency * (1.0 – constant))
        }
Load cues
threshold_load = (sqrt (threshold_power)) / threshold_frequency
current_load = (sqrt (current_power)) / current_frequency
    if (current_load < (threshold_load * 0.96 ))
```

-continued

```
                {
                        load_Emoji =👆
                }
    else if (current_load > (threshold_load * 1.13 ))
                {
                        load_Emoji =👇
                }
    else
                {
                        load_Emoji =😀
                }
Frequency Cues
    if (current_frequency > (threshold_frequency * 1.1))
                {
                        frequency_Emoji =😬
                }
    else if (current_frequency < (threshold_frequency * 0.9))
                {
                        frequency_Emoji =👆
                }
    else
                {
                        frequency_Emoji =😬
                }
```

After establishing baseline thresholds, the participant is asked to perform 'best safe surge' zones. The terminology can be altered depending on exercise mode, but the concept of concurrently reaching threshold frequency and threshold power is the same. Although the determined and dictated thresholds are frequency and power, the two factors that are most in a participant's control are frequency and load, so the system maintains frequency and power thresholds but calculates and displays participant cues using frequency and load. The display uses universal emojis, such as [pointing up emoji]=increase; [pointing down emoji]=decrease; and [grinning face emoji]=just right to dictate frequency and load.

Referring to FIG. 2, rider shown (nickname 'Majic') is maintaining both frequency and power thresholds correctly and gets confirmation with a [grinning face] emoji for both load and frequency on the panel display (#3). Another rider in the example image (nickname 'Fury') is at their threshold frequency, but their power is not at threshold, so the system cues the rider to increase load, which in turn will increase power. The [pointing up emoji] guides the rider to increase load and the [grinning face emoji] indicates the rider is at the right frequency. If previous thresholds are exceeded if/then logic in software determines if or how much the thresholds should be updated.

The present invention is made by combining exercise equipment adapted to measure and transmit frequency and power, a panel display that can give participants cues regarding exercise frequency and load, and a computing device with software that receives the data, applies an algorithm and sends cueing information to the panel display.

The system controller is necessary for receiving data, calculating thresholds and displaying thresholds. In the simplest example of a person walking, a smart watch could be used as sensors, system controller and display. Also, the system controller (in this instance, a mobile device) and exercise equipment could be used effectively for one participant, as the screen of the mobile device could be used to display threshold information to that participant. All elements could be combined in a wearable device, as one wearable could provide sensors, algorithm calculation and the threshold display. Multiple exercise device types could be used in one setting with sensor data coming from various equipment types while displaying threshold information to all or one large panel display. Also, the threshold information could be dictated to the participant using audio signals, automated voice or sound effects, instead or in addition to being visually displayed.

A method of using the present invention may include the following. The system to determine and dictate individual exercise thresholds to maximize desired neurological responses disclosed above may be provided. A user could participate in a group exercise class that utilizes the present invention, exercising with others while getting individual "coaching" on the panel display. Or a user could use an individual software application on a mobile device or wearable device that collects the data, applies the algorithm and displays or otherwise communicates the threshold information.

Additionally: The neurological benefits of exercising at the present invention's frequency and power thresholds could provide benefits to any number of neurological issues particularly those associated with the malformation of tau proteins such as Alzheimer's disease, Amyotrophic Lateral Sclerosis, Progressive Supranuclear Palsy or Multiple Sclerosis.

Also, the present invention embodied in the disclosed methods for determining and communicating frequency and power thresholds could be added to gym equipment's existing automated workout guidance or online workout guides already utilized by workout equipment manufacturers.

The computer-based data processing system and method described above is for purposes of example only, and may be implemented in any type of computer system or programming or processing environment, or in a computer program, alone or in conjunction with hardware. The present invention may also be implemented in software stored on a computer-readable medium and executed as a computer program on a general purpose or special purpose computer. For clarity, only those aspects of the system germane to the invention are described, and product details well known in the art are omitted. For the same reason, the computer hardware is not described in further detail. It should thus be understood that the invention is not limited to any specific computer language, program, or computer. It is further contemplated that the present invention may be run on a stand-alone computer system, or may be run from a server computer system that can be accessed by a plurality of client computer systems interconnected over an intranet network, or that is accessible to clients over the Internet. In addition, many embodiments of the present invention have application to a wide range of industries. To the extent the present application discloses a system, the method implemented by that system, as well as software stored on a computer-readable medium and executed as a computer program to perform the method on a general purpose or special purpose computer, are within the scope of the present invention. Further, to the extent the present application discloses a method, a system of apparatuses configured to implement the method are within the scope of the present invention.

It should be understood, of course, that the foregoing relates to exemplary embodiments of the invention and that modifications may be made without departing from the spirit and scope of the invention as set forth in the following claims.

What is claimed is:

1. A system to maximize neurological responses during a physical activity, comprising:

an exercise equipment configured to measure and transmit frequency and power during the physical activity;

a display; and a system controller, wherein the system controller is configured to:

receive a current power and a current frequency to update an average power and average frequency, update a power threshold and a frequency threshold using the updated average power and the updated average frequency, compare the updated power threshold and the updated frequency threshold with the current power and the current frequency, determine load and frequency emoji cues based on the comparison, and display the load and frequency emoji cues on the display.

2. The system of claim 1, further comprising: one or more sensors, electrically connected to the exercise equipment, for measuring the frequency and the power.

3. The system of claim 1, wherein the exercise equipment is selected from a group consisting of a bike, a treadmill, a rowing machine, and an elliptical machine.

4. The system of claim 1, wherein the system controller and the display comprise a smart watch.

5. A method of treating a neurological disorder using the system of claim 1, comprising:

a. providing the system of claim 1;

b. guiding a participant through an increasing power warm up;

c. displaying cues, to the participant, for high intensity power intervals;

d. displaying cues for on/off RPM challenge interval zones from comfortable to challenging frequencies; and e. prompting the participant to perform best safe surge zones.

* * * * *